US006776166B1

(12) United States Patent
Mills-Lindsay et al.

(10) Patent No.: US 6,776,166 B1
(45) Date of Patent: Aug. 17, 2004

(54) PORTABLE EXTINGUISHING ASH CONTAINER

(76) Inventors: Dorraine P. Mills-Lindsay, 21 Paxson Ave., Glenside, PA (US) 19038; Eileen C. Dittmar-DiDio, 21 Paxson Ave., Glenside, PA (US) 19038

( * ) Notice: Subject to any disclaimer, the term of this patent is extended or adjusted under 35 U.S.C. 154(b) by 30 days.

(21) Appl. No.: 10/295,521

(22) Filed: Nov. 15, 2002

(51) Int. Cl.[7] ..... A24D 1/12; A24F 15/00

(52) U.S. Cl. ..... 131/231; 131/235.1; 131/240.1; 131/241; 131/242; 131/256; 206/260; 220/23.87

(58) Field of Search ..... 131/235.1, 231, 131/240.1, 241, 242, 256; 206/246, 260, 268, 236; 220/23.87, 23.88, 23.89

(56) References Cited

U.S. PATENT DOCUMENTS 2,028,309 A * 1/1936 Adams ..... 383/43
2,044,377 A 6/1936 Bashur
D167,554 S 8/1952 Bergman
2,701,597 A * 2/1955 Levins, Jr. et al. ..... 206/260
4,108,153 A 8/1978 Pearson
4,194,657 A 3/1980 Thor
4,444,342 A 4/1984 Powell

* cited by examiner

*Primary Examiner*—Dionne A. Walls
(74) *Attorney, Agent, or Firm*—John D. Gugliotta; P. Jeff Martin

(57) ABSTRACT

A portable extinguishing ash container with pivoting lid is provided. The ash container features a flame-resistant fabric pouch which accommodates a metal container. The pouch is filled with a noncombustible granular material such as sand or pebbles for enveloping an outer surface of the ash container. A hinged circular, transparent lid allows the smoker to close the apparatus securely during transportation and to keep discarded butts and ashes inside. A small release button on the front causes the lid to open automatically when the button is pressed. Being transparent, the lid allows for various pictures, photographs, logos, or word phrases to be placed thereunder to provide for a visually appealing appearance. A pivoting cigarette platform is provided to permit resting support of a cigarette. A leather strap is included to facilitate transportability.

13 Claims, 6 Drawing Sheets

PORTABLE EXTINGUISHING ASH CONTAINER

RELATED APPLICATIONS

There are no previously filed, nor currently any co-pending applications, anywhere in the world.

BACKGROUND OF THE INVENTION

1. Field of the Invention

The present invention relates generally to ash trays and, more particularly, to a portable extinguishing ash container.

2. Description of the Related Art

There are many occasions when an individual desires to smoke, yet is unable to locate an ash tray. In addition, in view of present commercial codes and regulations restricting smoking to designated areas outside, individuals are forced into the objectionable practice of allowing ashes and cigarette butts to pollute the grounds and thus the environment.

A search of the prior art did not disclose any patents that read directly on the claims of the instant invention; however, the following references were considered related.

| U.S. Pat. No. | Inventor | Issue Date |
|---|---|---|
| 2,044,377 | Bashur | Jun. 16, 1936 |
| 4,444,342 | Powell | Apr. 24, 1984 |
| 4,194,657 | Thor | Mar. 25, 1980 |
| 4,108,153 | Pearson | Aug. 22, 1978 |
| Des. 167,554 | Bergman | Aug. 26, 1952 |
| WO 89/09556 | Galbraith | Apr. 11, 1989 |

Consequently, a need has been felt for a device which allows one to safely discard cigarette butts via an aesthetically pleasing, portable, self-contained ashtray in a manner which is quick, easy, and efficient.

SUMMARY OF THE INVENTION

Therefore, it is an object of the present invention to provide a portable extinguishing ash container having a pouch for accommodating an aluminum container.

It is another object of the present invention to provide a pouch fabricated of a heat and flame retardant fabric.

It is another object of the present invention to provide a pouch having an elastic retention means which functions to stretch to fit around and contract to fit the aluminum container.

It is another object of the present invention to provide an aluminum container having a transparent, circular lid hingedly attached thereto.

It is another object of the present invention to provide the circular lid being easily opened and closed via a snap closure assembly.

It is another object of the present invention to provide a pivoting cigarette platform to permit resting support of a cigarette.

It is another object of the present invention to provide a pouch having a sand storage receptacle for facilitating the storage of a noncombustible granular material.

It is another object of the present invention to provide an attached leather strap to facilitate easy transport of the present invention.

It is another object of the present invention to provide a device adapted to slidably accommodate various ornamental and aesthetic designs below the transparent circular lid.

It is still another object of the present invention to provide a lightweight device which is easily transportable.

Briefly described according to one embodiment of the present invention, a portable extinguishing ash container with pivoting lid is provided. The ash container features a flame-resistant fabric pouch lower portion which accommodates a concave, aluminum container. The pouch is filled with a noncombustible granular material such as sand or pebbles which houses the ash container. A hinged circular, transparent lid allows the smoker to close the apparatus securely during transportation and to keep discarded butts and ashes inside. A small release button on the front causes the lid to open automatically when the button is pressed.

The circular, transparent lid exhibits a picture showing a blue sky over an ocean and beach with a cigarette butt snuffed out in the sand. Such design represents the natural elements (land, sea, and sky) protected by using the present invention. Being transparent, the lid allows for various pictures, photographs, logos, or word phrases to be placed thereunder to provide for a visually appealing appearance.

A pivoting cigarette platform is provided to permit resting support of a cigarette. The platform has a length measuring approximately 1 inch.

The ash container has a diameter measuring approximately 2½ inches and is readily transportable via a leather strap attached thereto. The ash container can be made in various colors and styles and may be imprinted with company logos, trademarks, and the like.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
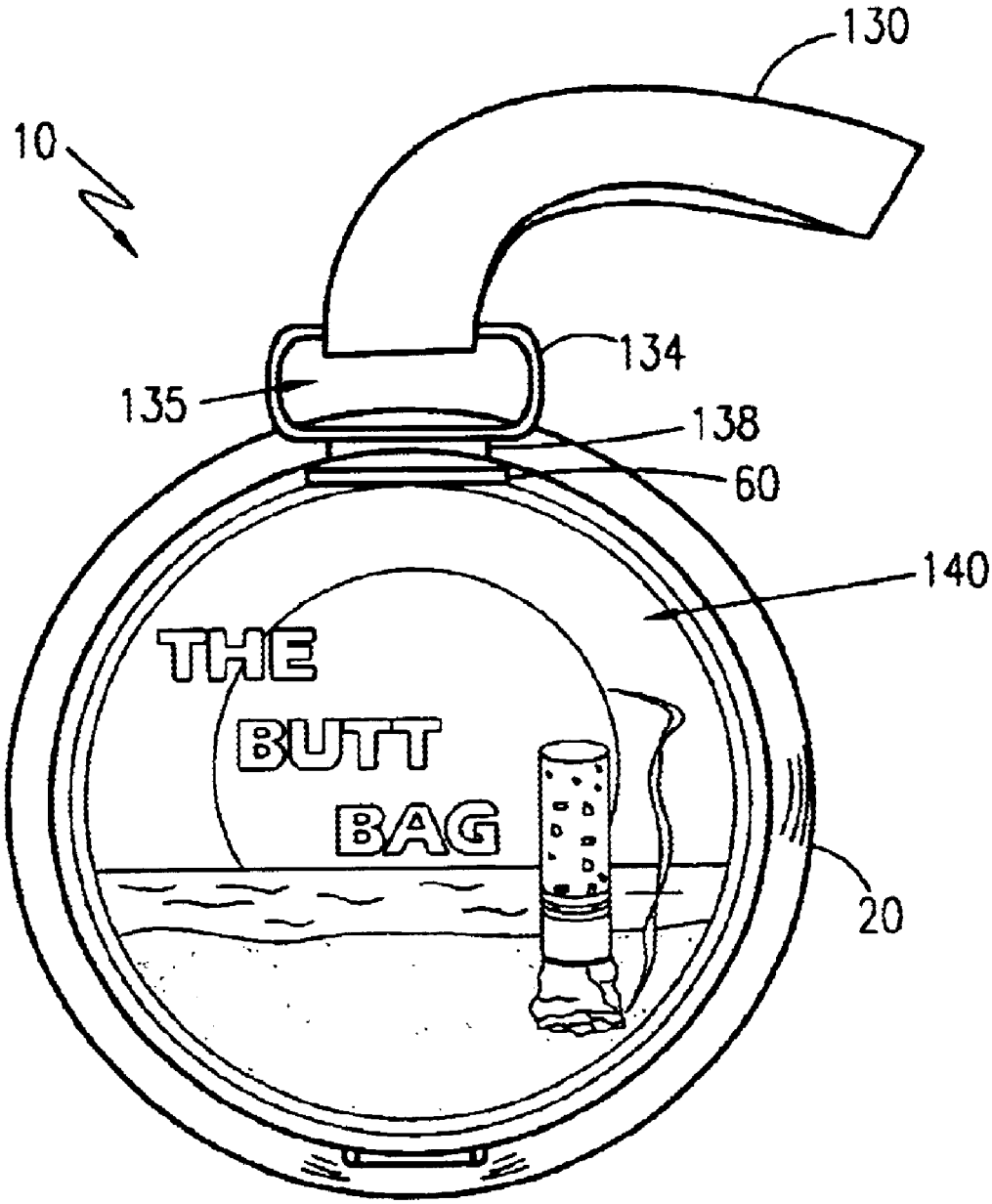
FIG. 1 is a perspective view of a portable extinguishing ash container according to the preferred embodiment of the present invention.
Figure 2:
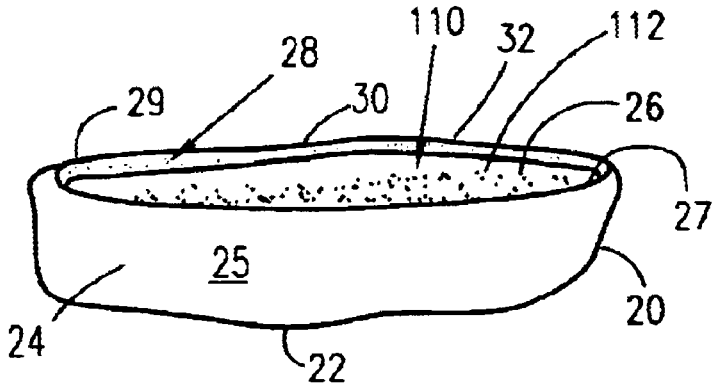
FIG. 2 is a perspective view of the pouch according to the preferred embodiment of the present invention.
Figure 3:
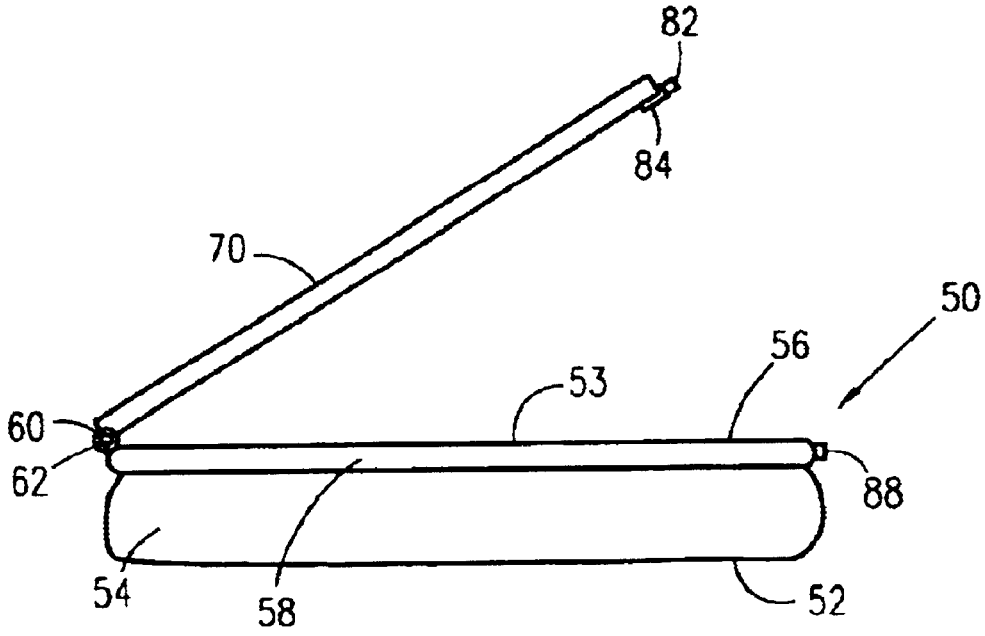
FIG. 3 is a side elevational view of the container according to the preferred embodiment of the present invention shown without pivoting cigarette platform.

Referring now to FIGS. 1–3, a portable extinguishing ash container 10 is shown, according to the present invention, comprised of a generally circular pouch 20 defined as having a bottom wall 22 bounded by an upwardly extending cylindrical sidewall 24 leaving an open top 26 which leads into a sand storage receptacle 27 for facilitating the storage of a noncombustible granular material 110, preferably sand 112. Once filled with sand 112, the pouch 20 is designed and configured for holding a container 50 in a conforming manner therein. The sand 112 envelops an outer surface of the container 50 so as to allow the bottom wall 22 of pouch 20 to conform to a surface on which pouch 20 is placed, thereby facilitating resting stability thereof. The pouch 20 is fabricated of a heat and flame retardant fabric 25.

A casing 28 is formed peripherally just below a top edge 29 of the pouch 20. The casing 28 is defined as a folded portion of fabric 30 within which a retention means 32 is encased. The folded portion of fabric 30 is sewn via stitching to an inner surface of sidewall 24. The retention means 32 is defined as an elastic band 33, the function of which to be described in greater detail below.

Referring now to FIGS. 3–8, a container 50 is provided having a concave, circular configuration. The container 50 is fabricated of a heat resistant metal, preferably aluminum, and includes a planar base 52 having a circular, bulbous sidewall 54 extending upwardly therefrom to a horizontal ring portion 56 having a downwardly extending flange 58, leaving an open top portion 53 leading into an ash storage receptacle 57. The pouch 20, when filled with sand 112, is designed and configured to accommodate the base 52 and circular, bulbous sidewall 54 of the container 50 in a conforming manner. Ashes, cigarette butts, matches, and the like are placed within the ash storage receptacle 57 of container 50 to facilitate extinguishment thereof.

The elastic band 33 functions to stretch to fit around and contract to fit the circular, bulbous sidewall 54 of container 50, just below the downwardly extending flange 58 of the horizontal ring portion 56.

A spring-biased hinge 60 is mounted to the horizontal ring portion 56 for hingedly attaching a transparent, circular lid 70. The hinge 60 includes a spring 62 serving to bias the circular lid 70 to an open position. The circular lid 70 is formed of an annular flange 72 having a transparent, circular, planar layer of plastic 77 suitably mounted thereto. The circular lid 70 is securely closed via a snap closure assembly 80.

The snap closure assembly 80 includes a spring-biased retractable tab 82 which projects from its housing 84 via spring 85 while lid 70 is open. Housing 84 is mounted to a collar 73 of the annular flange 72 of the lid 70 opposite to hinge 60. The tab 82 is designed and configured to engage a depressable button 88 which is slidably mounted via springs 89 within a rectangular receptacle 90 integrally formed within downwardly extending flange 58 of container, positioned opposite of hinge 60. When closing the circular lid 70, tab 82, in its extended position, mechanically engages depressable button 88 so as to force depressable button 88 in an outward, projecting position, while tab 82 mechanically interferes with an inner wall of the rectangular receptacle 90, thus effectively and securely holding circular lid 70 in a closed position.

In order to open the circular lid 70, user simply presses depressable button 88, which actuates mechanical engagement of depressable button 88 with tab 82, thereby facilitating retraction of tab 82 and removing mechanical interference of tab 82 with inner wall of rectangular receptacle 90. Circular lid 70 is then biased to an open position via spring 62 of hinge 60.

Figure 4:
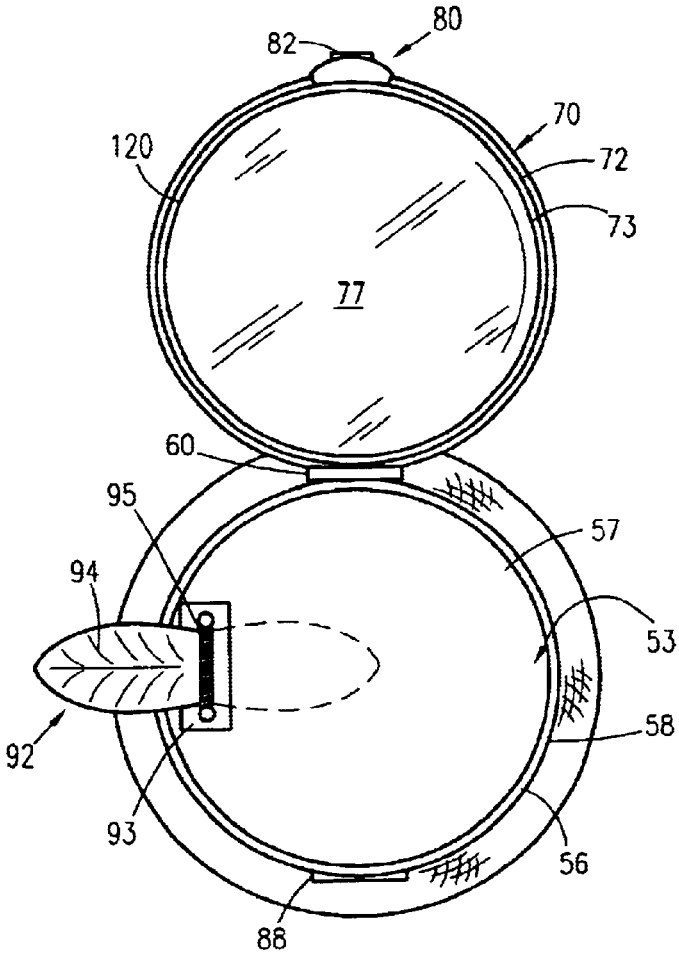
FIG. 4 is a top plan view of the present invention showing the circular lid in an open position, according to the preferred embodiment of the present invention.
Figure 5:
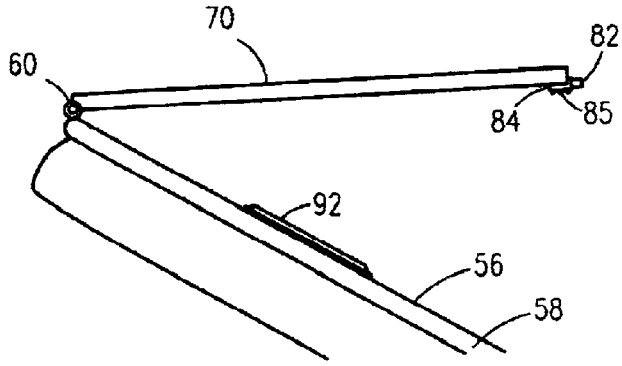
FIG. 5 is partial side elevational view of the snap closure assembly.
Figure 6:
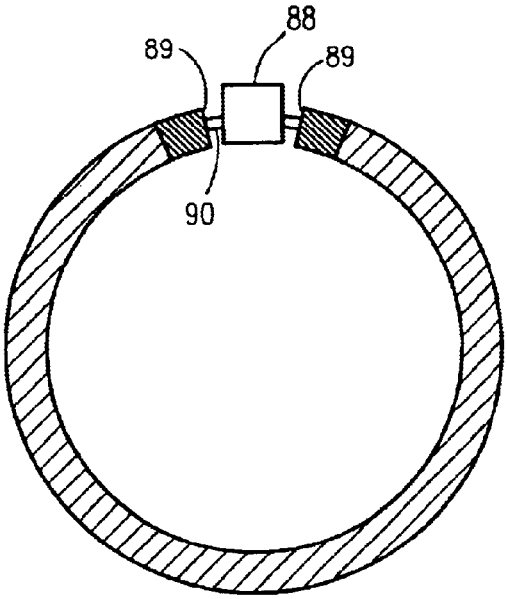
FIG. 6 is a cross-sectional view of the annular flange of the circular lid.
Figure 7:
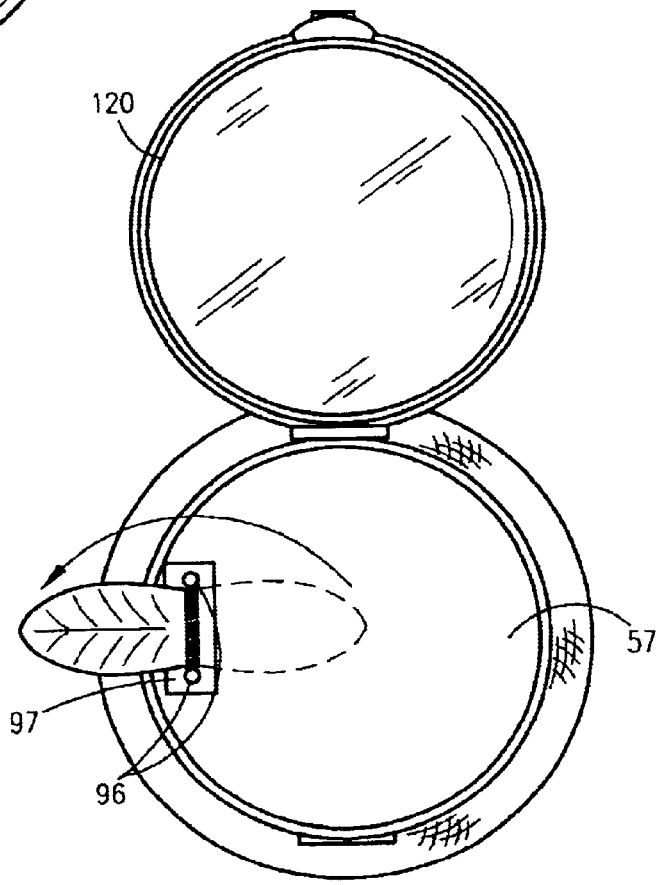
FIG. 7 is a top plan view of the present invention showing the circular lid in an open position and further illustrating the pivoting cigarette platform, according to the preferred embodiment of the present invention.
Figure 8:
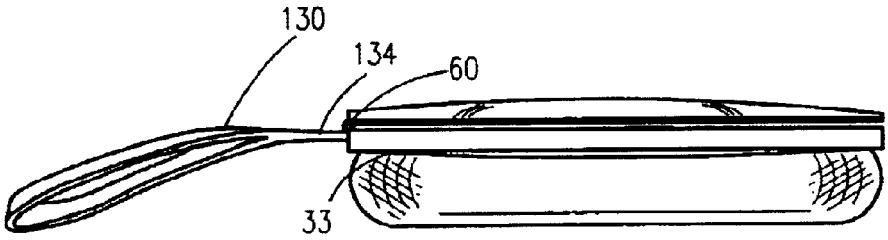
FIG. 8 is a side elevational view of the present invention showing the leather strap according to the preferred embodiment.
Figure 9:
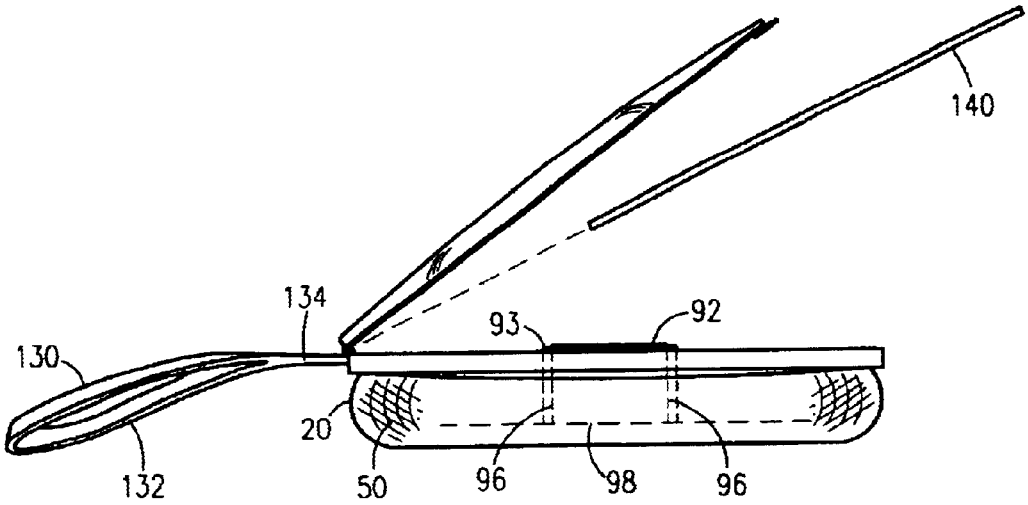
FIG. 9 is an exploded perspective view of the present invention showing insertion of a picture design below the circular lid.
Figure 10:
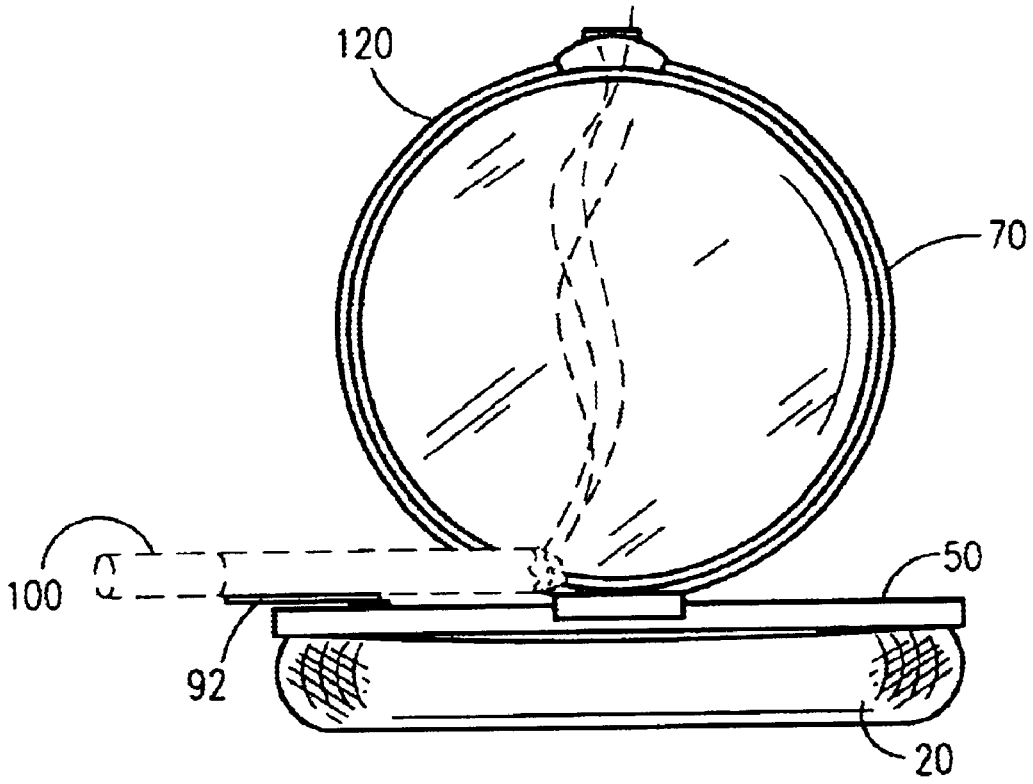
FIG. 10 is front end elevational view of the present invention shown in-use according to the preferred embodiment.

Referring more specifically to FIGS. 4, 5, and 7–10, a pivoting cigarette platform 92 is provided to permit resting support of a cigarette 100. The platform 92 is generally oval-shaped and designed so as to resemble a leaf, complete with simulated leaf vein engraving 94. The platform 92 is fabricated of aluminum and is pivotally attached to a platform bracket 93 via a helical spring 95. Bracket 93 is riveted to the base 52 of container 50 via a pair of rivets 96 penetrating a top wall 97 of bracket 93, through a bottom wall 98 thereof, and through the base 52 of container 50. The helical spring 95 is configured so as to spring bias the platform 92 to an open position, wherein open position is defined as where platform 92 traverses the horizontal ring portion 56 so as to reside in an overhanging position relative thereto, as shown in FIGS. 4, 7, and 10. The helical spring 95 is further designed and configured so as to allow the platform 92 to pivotally travel from a manually positioned orientation lying horizontal, within the container 50 and just below the circular lid 70, over an arcuate path of approximately 180°, as shown in FIG. 7. Thus, upon opening the circular lid 70, the platform 92 springably pivots automatically over an arcuate path of approximately 180° so as to provide a rest support for a cigarette 100.

In order to prevent accidental leakage of ashes from the ash storage receptacle 57 once the circular lid 70 has been closed, a thin, soft rubber membrane 120 is circumferentially adhered to the collar 73 of annular flange 72 of the circular lid 70 so as to form an air-tight seal upon closure of lid 70 against the horizontal ring portion 56 of container 50.

In order to facilitate easy transport of the present invention, an elongated leather strap 130, having a length measuring approximately 3½ inches and formed as a looped element 132, is provided. The leather strap 130 is attached to a strap bracket 134 of a generally rectangular configuration having a central void volume 135, and includes a projecting member 138 mounted to the downwardly extending flange 58 of horizontal ring portion 56 just below hinge 60. It is envisioned that the leather strap 130 may be utilized for attachment to a belt or purse.

It is further envisioned that various ornamental and aesthetic designs 140 illustrated through the use of pictures, photographs, and the like in the form of ornamental discs may be adapted for slidable placement below the circular lid 70, in view of the transparent layer of plastic 77 incorporated therewith, so as to provide for countless, pleasing designs visibly revealed therethrough. FIG. 1 depicts a design 140 of a planar, circular configuration illustrating a sky over an ocean and a beach.

2. Operation of the Preferred Embodiment

To use the present invention, user simply presses depressable button 88 which facilitates retraction of tab 82, wherein spring 62 of hinge 60 biases the circular lid 70 to an open position. Opening of circular lid 70 further actuates pivoting cigarette platform 92 to be spring biased via helical spring 95 to an open position, so as to provide a rest support for a cigarette 100. Once user has finished smoking, the cigarette butt is placed within the ash storage receptacle 57, and the circular lid 70 is snapped shut.

The present invention allows one to safely discard cigarette butts via an aesthetically pleasing, portable, self-contained ashtray in a manner which is quick, easy and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. An ash container comprising:

a pouch, said pouch is of a generally circular configuration fabricated of a heat and flame retardant fabric;

a container, said container has a concave, circular configuration being fabricated of a heat resistant metal and is held within said pouch in a conforming manner;

a transparent, circular lid, said transparent, circular lid is hingedly mounted to said container; and a snap closure assembly, said snap closure assembly facilitates secure closure of said transparent, circular lid.

2. The ash container of claim 1, wherein said pouch has a bottom wall bounded by an upwardly extending cylindrical sidewall leaving an open top which leads into a sand storage receptacle for facilitating storage of a noncombustible granular material.

3. The ash container of claim 1, wherein said container includes a planar base having a circular, bulbous sidewall extending upwardly from said planar base to a horizontal ring portion having a downwardly extending flange and leaving an open top portion which leads into an ash storage receptacle.

4. The ash container of claim 1, wherein said container is fabricated of aluminum.

5. The ash container of claim 1, wherein said pouch defines a casing formed peripherally just below a top edge of said pouch, wherein said casing is defined as a folded portion of fabric which encases a retention means, and wherein said folded portion of fabric is sewn via stitching to an inner surface of said cylindrical sidewall of said pouch.

6. The ash container of claim 1, wherein said transparent, circular lid is formed of an annular flange having a transparent, circular, planar layer of plastic suitably mounted thereto.

7. The ash container of claim 2, wherein said noncombustible granular material is sand, wherein said sand envelops an outer surface of said container so as to allow said bottom wall of said pouch to conform to a surface on which said pouch is placed, thereby facilitating resting stability of said pouch.

8. The ash container of claim 5, wherein said retention means is an elastic band, said elastic band functions to stretch to fit around and contract to fit said circular, bulbous sidewall of said container, just below said downwardly extending flange of said horizontal ring portion.

9. The ash container of claim 1, wherein said transparent, circular lid is hingedly mounted via spring-biased hinge to said horizontal ring portion of said container, said spring-biased hinge includes a spring serving to bias said transparent, circular lid to an open position.

10. The ash container of claim 1, wherein said snap closure assembly includes a housing from which a spring-biased retractable tab projects via a spring when said transparent, circular lid is open, said housing is mounted to a collar of said annular flange of said transparent, circular lid wherein said housing is located opposite to said spring-biased hinge, said tab is designed and configured to engage a depressable button which is slidably mounted via springs within a rectangular receptacle integrally formed within said downwardly extending flange of said container, said rectangular receptacle is positioned opposite of said spring-biased hinge, whereupon closure of said transparent, circular lid actuates mechanical engagement by said tab with said depressable button so as to force said depressable button in an outward, projecting position, while said tab mechanically interferes with an inner wall of said rectangular receptacle, thus effectively and securely holding said transparent, circular lid in a closed position, and whereupon pressure is applied to said depressable button, said depressable button mechanically engages said tab, thereby facilitating retraction of said tab and removing mechanical interference of said tab with said inner wall of said rectangular receptacle so as to effectively open said transparent, circular lid.

11. The ash container of claim 1, further comprising:

a pivoting cigarette platform for permitting resting support of a cigarette, said pivoting cigarette platform is generally oval-shaped and designed so as to resemble a leaf, complete with simulated leaf vein engraving, said pivoting cigarette platform is fabricated of aluminum and is pivotally attached to a platform bracket via a helical spring, wherein said platform bracket is riveted to said base of said container via a pair of rivets penetrating a top wall of said platform bracket, through a bottom wall of said platform bracket, and through said base of said container;

a thin, soft rubber membrane, said rubber membrane is circumferentially adhered to a collar of said annular flange of said transparent, circular lid so as to form an air-tight seal upon closure of said transparent, circular lid against said horizontal ring portion of said container, thereby preventing accidental leakage of ashes from said ash storage receptacle;

an elongated leather strap, said elongated leather strap is mounted via a strap bracket to said downwardly extending flange of said horizontal ring portion just below said spring-biased hinge; and ornamental and aesthetic designs illustrated through the use of pictures, photographs, and the like formed as ornamental discs adapted for slidable placement below said transparent, circular lid, so as to provide for countless, pleasing designs visibly revealed through said transparent, circular lid.

12. The ash container of claim 11, wherein said helical spring is configured to facilitate pivotal travel of said pivoting cigarette platform in a spring biased manner from a manually positioned orientation lying horizontal, within said container and just below said transparent, circular lid, over an arcuate path of approximately 180° to an open position, wherein said open position is defined as where said pivoting cigarette platform traverses said horizontal ring portion so as to reside in an overhanging position relative to said horizontal ring portion.

13. The ash container of claim 11, wherein said elongated leather strap has a length measuring approximately 3½ inches and is formed as a looped element which is attached to said strap bracket, wherein said strap bracket is of a generally rectangular configuration having a central void volume and wherein said strap bracket includes a projecting member mounted to said downwardly extending flange of said horizontal ring portion.

* * * * *